US010083656B2

(12) United States Patent
Na et al.

(10) Patent No.: US 10,083,656 B2
(45) Date of Patent: Sep. 25, 2018

(54) ORGANIC LIGHT-EMITTING DIODE (OLED) DISPLAY PANEL, OLED DISPLAY DEVICE AND METHOD FOR DRIVING THE SAME

(71) Applicant: LG Display Co., Ltd., Seoul (KR)

(72) Inventors: Se-Hwan Na, Paju-si (KR); Jae-Young Lee, Seoul (KR); Mi-Jung Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 106 days.

(21) Appl. No.: 15/272,350

(22) Filed: Sep. 21, 2016

(65) Prior Publication Data

US 2017/0092193 A1 Mar. 30, 2017

(30) Foreign Application Priority Data

Sep. 25, 2015 (KR) ..... 10-2015-0136459

(51) Int. Cl.
*G09G 3/3233* (2016.01)

(52) U.S. Cl.
CPC ... *G09G 3/3233* (2013.01); *G09G 2300/0814* (2013.01); *G09G 2300/0819* (2013.01); *G09G 2300/0842* (2013.01); *G09G 2300/0861* (2013.01); *G09G 2300/0866* (2013.01); *G09G 2310/0251* (2013.01); *G09G 2310/0286* (2013.01); *G09G 2320/0252* (2013.01); *G09G 2320/0257* (2013.01); *G09G 2330/00* (2013.01); *G09G 2330/04* (2013.01)

(58) Field of Classification Search
CPC ..... G09G 3/3233; G09G 2300/0842; G09G 2330/04; G09G 2320/0257; G09G 2320/0252; G09G 2310/0286
See application file for complete search history.

(56) References Cited

U.S. PATENT DOCUMENTS

2011/0115764 A1 5/2011 Chung
2014/0152719 A1 6/2014 Jung

FOREIGN PATENT DOCUMENTS

EP 2602783 A1 6/2013
KR 2013-0030879 A 3/2013

OTHER PUBLICATIONS

European Extended Search Report, European Application No. 16190336.4, dated Dec. 1, 2016, 11 pages.

*Primary Examiner* — Shaheda Abdin
(74) *Attorney, Agent, or Firm* — Fenwick & West LLP

(57) ABSTRACT

Disclosed herein are an OLED display panel further including a switching transistor for controlling application of supply voltage in the initializing interval of a pixel, an OLED display device including the same, and a method for driving the same. The OLED display panel avoids a short-circuit between supply voltage VDD_EL and reference voltage Vref to thereby reduce initialization voltage applied to the gate terminal of the driving transistor T_dr. The OLED display device can achieve various effects such as improved response characteristics of pixels by reducing deviation in the initial voltage used in sampling.

17 Claims, 11 Drawing Sheets

ORGANIC LIGHT-EMITTING DIODE (OLED) DISPLAY PANEL, OLED DISPLAY DEVICE AND METHOD FOR DRIVING THE SAME

CROSS REFERENCE TO RELATED APPLICATION(S)

This application claims priority from Republic of Korea Patent Application No. 10-2015-0136459 filed on Sep. 25, 2015, the contents of which are incorporated by reference herein in its entirety.

BACKGROUND

1. Technical Field

The present disclosure relates to an organic light-emitting diode (OLED) display panel, an OLED display device including the same, and a method for driving the same. More specifically, the present disclosure relates to an OLED display panel further including a switching transistor for controlling application of supply voltage in the initializing interval of a pixel, an OLED display device including the same, and a method for driving the same.

2. Description of the Related Art

As the information-oriented society evolves, various demands for display devices are ever increasing. Recently, a variety of flat display devices such as liquid-crystal display (LCD) devices, plasma display panel (PDP) devices, and organic light-emitting diode (OLED) display devices have been utilized.

Among these, an OLED display device is advantageous over other flat display devices in that it can be driven with low voltage, can be made thinner, has good viewing angle and fast response speed, and so on. Accordingly, OLED display devices find more and more applications.

FIG. 1 is a circuit diagram of a pixel of an OLED display device in the related art, FIG. 2 is a timing chart for driving the pixel, and FIG. 3 is a graph showing response time (R/T) characteristics according to different initializing time intervals.

FIG. 1 is an equivalent circuit diagram of a pixel of an OLED display device in the related art, which has the typical 6T1C (six transistors and one capacitor) structure.

Referring to FIG. 1, the pixel of the typical OLED display device includes six transistors, one capacitor, an OLED, etc.

That is, in the pixel area, first to fourth transistors T1 to T4, a switching transistor T_sw, a driving transistor T_dr, a storage capacitor C, and an OLED may be formed.

The first to fourth transistors T1 to T4, the switching transistor T_sw and the driving transistor T_dr may be p-type transistors.

The source electrode of the switching transistor T_sw is connected to a data line, the gate electrode of the switching transistor T_sw is connected to a scan line, and the drain electrode of the switching transistor T_sw is connected to a terminal of the storage capacitor C. The switching transistor T_sw is turned on when a scan signal Scan is applied via the scan line to allow data voltage to be applied to the storage capacitor C.

The source electrode of the first transistor T1 is connected to a reference voltage line Vref and the gate electrode of the first transistor T1 is connected to an emission control line, and the drain electrode of the first transistor T1 is connected to the terminal of the storage capacitor C. The first transistor T1 is turned on when an emission control signal EM is applied via the emission control line to allow reference voltage Vref to be applied to the terminal of the storage capacitor C.

The source electrode of the second transistor T2 is connected to the other terminal of the storage capacitor C, the gate electrode of the second transistor T2 is connected to the scan line, and the drain electrode of the second transistor T2 is connected to the drain electrode of the driving transistor T_dr.

The source electrode of the third transistor T3 is connected to the drain electrode of the driving transistor T_dr, the gate electrode of the third transistor T3 is connected to the emission control line, and the drain electrode of the third transistor T3 is connected to the anode electrode of the OLED.

The source electrode of the fourth transistor T4 is connected to the anode electrode of the OLED, the gate electrode of the fourth transistor T4 is connected to the scan line, and the drain electrode of the fourth transistor T4 is connected to the reference voltage Vref line.

The source electrode of the driving transistor T_dr is connected to the supply voltage VDD_EL terminal, the gate electrode of the driving transistor T_dr is connected to the other terminal of the storage capacitor C, and the drain electrode of the driving transistor T_dr is connected to the drain electrode of the second transistor T2. While the driving transistor T_dr is turned on, current flows to the OLED so that the OLED emits light.

The intensity of the light emitted from the OLED is proportional to the amount of the current flowing in the OLED, and the amount of the current flowing in the OLED is proportional to the magnitude of the data voltage DATA applied to the gate electrode of the driving transistor T_dr.

In this manner, the OLED display device can display a variety of images by applying data voltages having different magnitudes to the pixel areas to display different gradations.

The storage capacitor C holds data voltage DATA for a frame to regulate the amount of the current flowing in the OLED and maintains the gradation displayed by the OLED.

FIG. 2 is a timing chart for driving the OLED display device of FIG. 1.

Referring to FIG. 2, it can be seen that the emission control signal EM is deactivated immediately after the scan signal Scan is applied. In doing so, data addressing and Vth (threshold voltage) compensation are carried out. In particular, the time period in which both of the emission control signal EM and the scan signal Scan are in on-state is the initializing time interval I of the pixel. It is noted that since the transistors are P type transistors, the emission control signal EM and scan signal Scan are active and in the on-state when they are logic low, and they are deactivated and in the off-state when they are logic high.

For the pixel having the 6T1C structure described above with reference to FIG. 1, all of the transistors are turned on during the initializing time interval I in which both of the emission control signal EM and the scan signal Scan are in on-state.

In other words, the gate electrodes of all of the transistors T_sw, T_dr and T1 to T4 disposed in the pixel receive the emission control signal EM or the scan signal Scan directly or indirectly, and thus all of the transistors remain turned on during the time interval I in which the scan signal is applied on the scan line, and the signal on the emission control line EM is in an on-state.

As a result, a short-circuit is created between the supply voltage VDD_EL and the reference voltage Vref during the initializing time interval I. That is, the initialization voltage applied at the gate terminal of the driving transistor T_dr equals to:

$$VDD_EL-Vref-a,$$

where a denotes a voltage that varies depending on data of a previous frame.

Due to the voltage a, the voltage at the gate terminal of the driving transistor T_dr increases in black screens while it decreases in white screens, such that deviation in the initial voltage used in sampling occurs, resulting in response time delay.

Such a problem can be somewhat improved by increasing the initializing time interval. However, there is a problem in that the luminous efficiency at the first frame is still less than or equal to 50%.

FIG. 3 is a graph showing response time characteristics of the OLED display device shown in FIG. 1 according to different initializing time intervals. That is, FIG. 3 is a graph showing changes in brightness according to initializing time intervals when the screen is changed from black to white.

FIG. 3 shows changes in brightness over time according to the initialization times of 0 μs (a), 1 μs (b) and 2 μs (c). It can be seen that the longer initializing time intervals exhibit better response characteristics. However, it can be seen that the brightness immediately after the screen is changed from black to white (after 0.01 second) is still 50% or less of the normal value in all of the initialization times of (a), (b) and (c).

SUMMARY

It is an aspect of the present disclosure to provide an OLED display panel further including a switching transistor for controlling application of supply voltage VDD_EL in the initializing time interval of a pixel, an OLED display device including the same, and a method for driving the same.

It is another aspect of the present disclosure to provide an OLED display panel with improved response characteristics of pixels by way of avoiding a short-circuit between supply voltage VDD_EL and reference voltage Vref to thereby reduce initialization voltage applied to the gate terminal of the driving transistor T_dr.

It is yet another aspect of the present disclosure to provide an OLED display panel with improved response characteristics by increasing the initialization time interval of pixels, an OLED display device including the same, and a method for driving the same.

As described above, the OLED display device having the typical 6T1C pixel structure has the problem that response time delay occurs due to deviation in the initial voltage used in sampling, especially when the screen is changed from black to white.

In one embodiment, to overcome the problem, an exemplary embodiment of the present disclosure provides an OLED display panel further including an additional transistor T5 which is disposed between the supply voltage VDD_EL terminal and the driving transistor T_dr and controls application of the supply voltage VDD_EL to the driving transistor T_dr during the process of initializing a pixel.

A control signal of the transistor T5 may be another emission control signal EM(n−1) of the immediately previous stage of a circuit that generates the emission control signal EM(n), a processed signal using an emission control signal EM(n−k) of a previous stage ahead of the emission control signal EM(n) by k stages, or a control signal supplied from a separate driving circuit.

In the exemplary embodiment, a scan signal may be continuously applied in an active state while the control signal is supplied in an active state and the emission control signal EM(n) is deactivated, and the time period in which the control signal is supplied in the active state may be used as the initializing time interval of the pixel.

In addition, with the configuration, it is possible to avoid a short-circuit from being created between the supply voltage VDD_EL and the reference voltage Vref during the initializing time interval of a pixel, such that the initial voltage applied to the gate terminal of the driving transistor T_dr can be reduced. As a result, there are many advantages such as reduced deviation in the initial voltage used in sampling, improved response characteristics of the pixel, and so on.

According to an exemplary embodiment of the present disclosure, it is possible to eliminate the possibility that a short-circuit is created between the supply voltage VDD_EL and the reference voltage Vref during the initializing time interval of a pixel.

Accordingly, the initial voltage applied to the gate terminal of the driving transistor T_dr can be reduced, such that deviation in the initial voltage used in sampling can be reduced. As a result, the response characteristics of the pixel can be improved.

In addition, the initializing time interval of the pixel can be increased by using the control signal for the supply voltage VDD_EL, thereby further improving response characteristics.

Moreover, the initial sampling voltage can be uniformly applied to the pixels with the reference voltage Vref, such that defects such as afterimage or spots can be suppressed.

DETAILED DESCRIPTION

Figure 1:
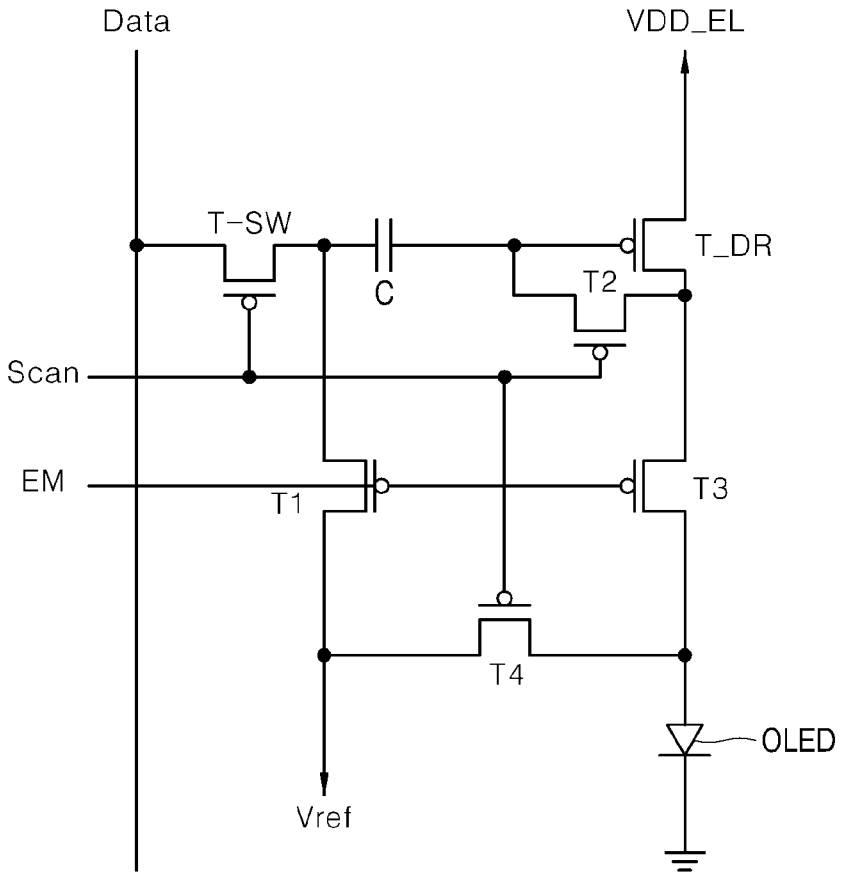
FIG. 1 is an equivalent circuit diagram of a pixel of an OLED display device in the related art.
Figure 2:
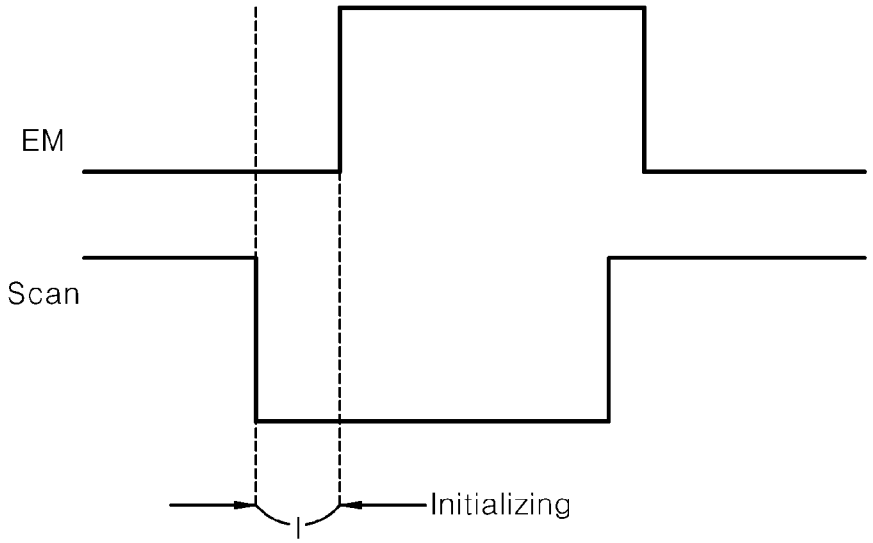
FIG. 2 is a timing chart for driving the OLED display device of FIG. 1.

The above objects, features and advantages will become apparent from the detailed description with reference to the accompanying drawings. Embodiments are described in sufficient detail to enable those skilled in the art in the art to easily practice the technical idea of the present disclosure. Detailed disclosures of well known functions or configurations may be omitted in order not to unnecessarily obscure the gist of the present disclosure. Hereinafter, embodiments of the present disclosure will be described in detail with reference to the accompanying drawings. Throughout the drawings, like reference numerals refer to like elements.

Figure 4:
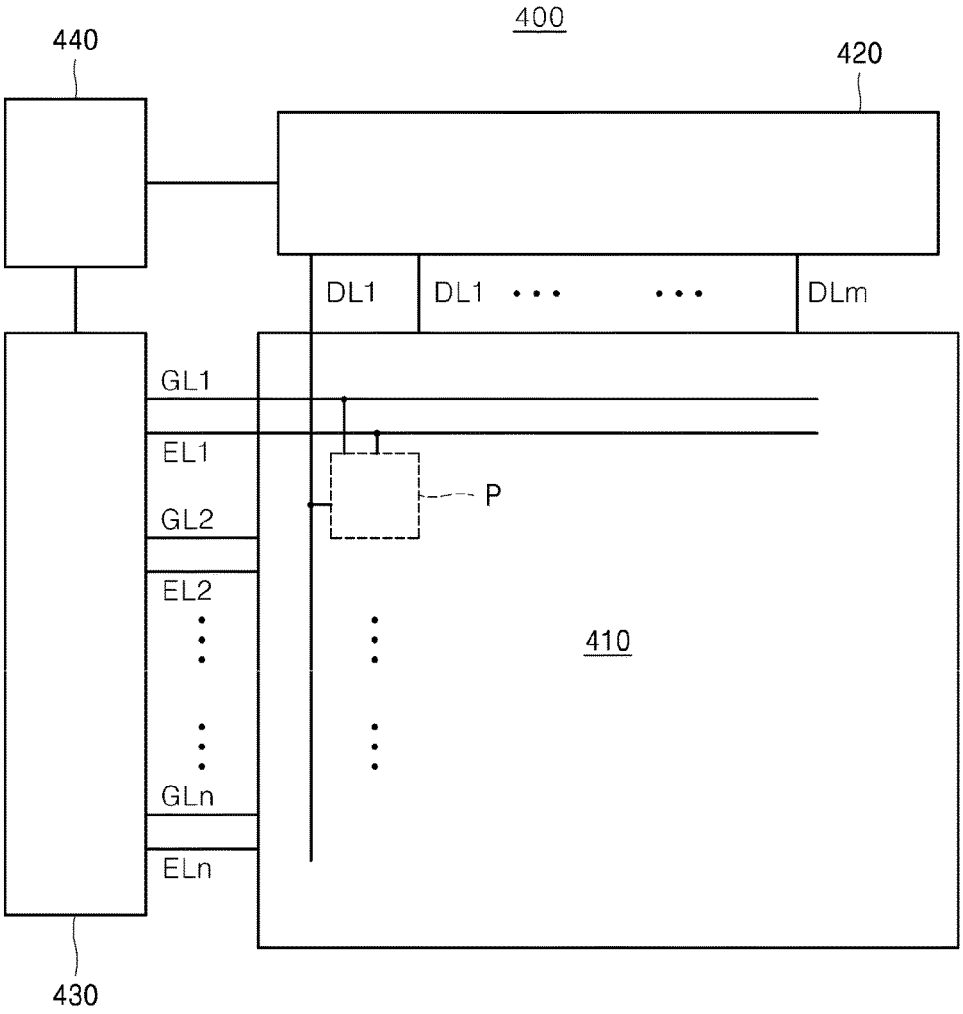
FIG. 4 is a block diagram of an OLED display device according to an exemplary embodiment of the present disclosure.

FIG. 4 is a block diagram of an OLED display device according to an exemplary embodiment of the present disclosure.

Referring to FIG. 4, the OLED display device 400 according to the exemplary embodiment of the present disclosure includes a display panel 410 for displaying images, a data driver 420, a gate driver 430, and a timing controller 440 for controlling the timings of the data driver 420 and the gate driver 430, etc.

The display panel 410 may include: a plurality of scan lines GL1 to GLn; a plurality of data lines DL1 to DLm intersecting the scan lines to define a plurality of pixel areas P; and a plurality of emission control lines EL1 to ELn. Each emission control line EL is connected to a row of pixels P. In some embodiments, an emission control line EL can be connected to two pixel rows and used for emission control for one row of pixels and used to control initialization time for another row of pixels. In one embodiment, a shift register circuit (not shown) generates the emission control signals for the emission control lines EL1 to ELn. The shift register circuit has multiple sequential register stages that shift one or more bits from one stage to the next in each clock cycle. The shift register can generate the emission control signals such that one emission control signal is active at a time.

Although not shown in FIG. 4, a plurality of initialization lines and a plurality of control lines for supplying signals for controlling the pixel areas P may be disposed in the display panel 410 in parallel with the plurality of scan lines GL1 to GLn.

All of the pixel areas P have the same configuration and thus only one pixel will be described below. In the following description, a scan line GL represents the plurality of scan lines GL1 to GLn, a data line DL represents the first to $m^{th}$ data lines DL1 to DLm, and an emission control line EL represents the plurality of emission control lines EL1 to ELn.

In each of the pixel areas P, first to fifth transistors T1 to T5, a switching transistor T_sw, a driving transistor T_dr, a storage capacitor C, and an OLED may be formed. The transistors may be p-type transistors as shown in the drawings. The configuration of each of the pixel areas P and elements thereof will be described in detail with reference to the drawings below.

The data driver 420 may include one or more ICs (not shown) supplying a data signal to the display panel 410. The data driver 420 generates a data signal by using a converted image signal R/G/B received from the timing controller 440 and a plurality of data control signals, and supplies the generated data signal to the display panel 410 via the data line DL.

The timing controller 440 may receive a plurality of image signals, a plurality of control signals such as a vertical synchronization signal VSY, a horizontal synchronization signal HSY and a data enable signal DE, etc., from a system such as a graphic card via an interface. In addition, the timing controller 440 may generate a plurality of data signals to supply them to the driver ICs in the data driver 420.

The gate driver 430 generates a scan signal by using a control signal received from the timing controller 440 and supplies the generated scan signal to the display panel 410 via the scan line GL.

That is, the OLED display device according to the exemplary embodiment shown in FIG. 4 provides the pixel P having the 7T1C structure instead of the typical 6T1C structure. The additional fifth transistor T5 is switched on/off to control the supply voltage VDD_EL to be applied to the driving transistor T_dr. Hereinafter, the pixel structures of OLED display devices according to exemplary embodiments of the present disclosure will be described with reference to the drawings.

Figure 5A:
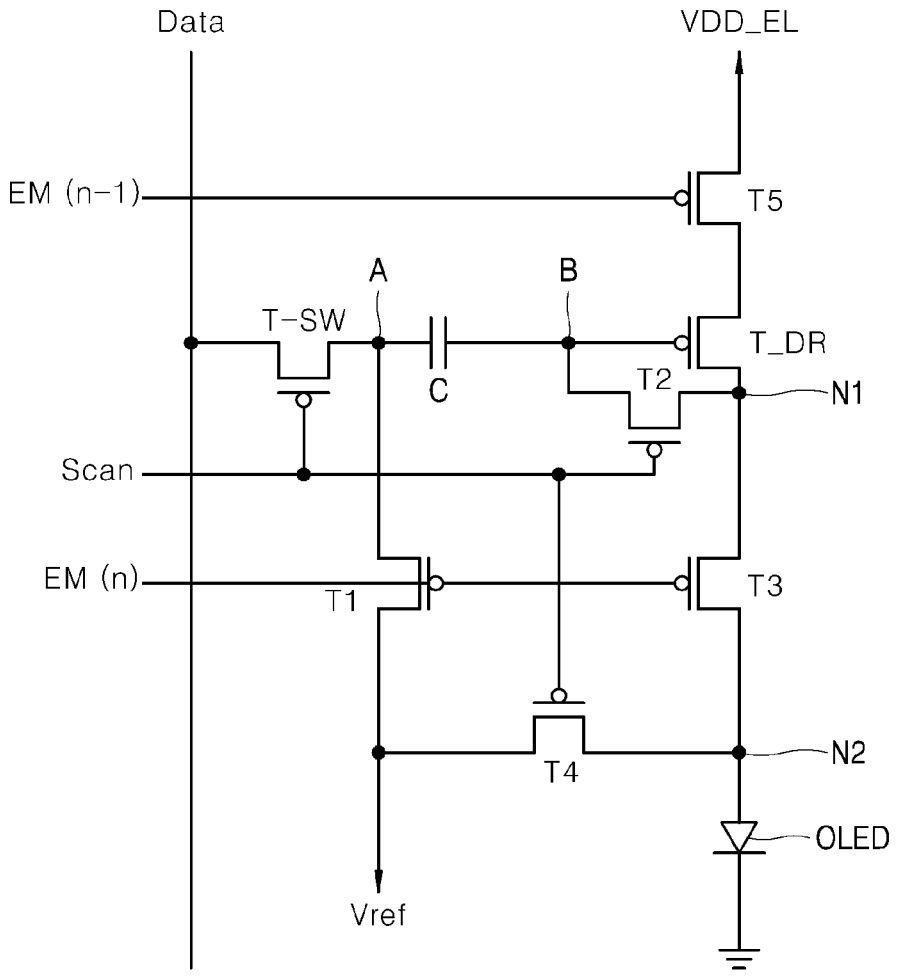
FIG. 5A is an equivalent circuit diagram of a pixel of an OLED display device according to an exemplary embodiment of the present disclosure.
Figure 5B:
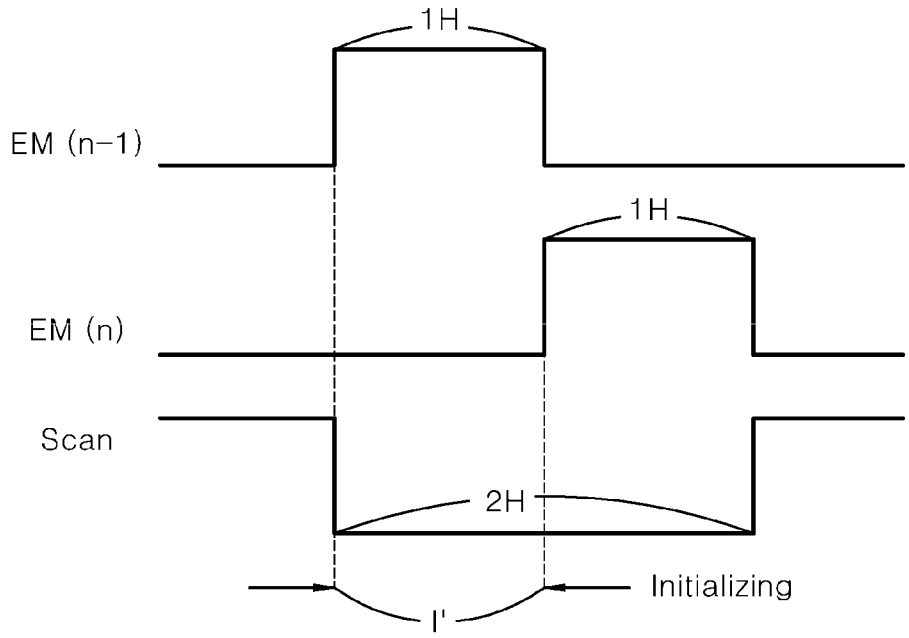
FIG. 5B is a timing chart for driving the OLED display device of FIG. 5A.

FIG. 5A is an equivalent circuit diagram of a pixel of an OLED display device according to an exemplary embodiment of the present disclosure. FIG. 5B is a timing chart for driving the OLED display device of FIG. 5.

Referring to FIG. 5A, a pixel of an OLED display device according to an exemplary embodiment of the present disclosure includes seven transistors, one capacitor, an OLED, etc.

That is, in the pixel area P, first to fifth transistors T1 to T5, a switching transistor T_sw, a driving transistor T_dr, a storage capacitor C, and an OLED may be formed.

The source electrode of the switching transistor T_sw is connected to a data line DATA, the gate electrode of the switching transistor T_sw is connected to a scan line Scan, and the drain electrode of the switching transistor T_sw is connected to a terminal A of the storage capacitor C.

The switching transistor T_sw is turned on when a scan signal Scan is applied via the scan line to allow data voltage to be applied to the storage capacitor C, wherein the switching transistor T_sw is configured to allow the data signal to be supplied to an output stage in response to the scan signal.

The source electrode of the first transistor T1 is connected to a reference voltage Vref line, the gate electrode of the first transistor T1 is connected to an emission control line, and the drain electrode of the first transistor T1 is connected to the terminal A of the storage capacitor C. The first transistor T1 is turned on when an emission control signal EM(n) is applied via the emission control line to allow the reference voltage Vref to be applied to the terminal A of the storage capacitor C.

The source electrode of the second transistor T2 is connected to the other terminal B of the storage capacitor C, the gate electrode of the second transistor T2 is connected to the scan line, and the drain electrode of the second transistor T2 is connected to a first node N1.

The source electrode of the third transistor T3 is connected to the first node N1, the gate electrode of the third transistor T3 is connected to the emission control line, and the drain electrode of the third transistor T3 is connected to a second node N2.

The source electrode of the fourth transistor T4 is connected to the second node N2, the gate electrode of the fourth transistor T4 is connected to the scan line, and the drain electrode of the fourth transistor T4 is connected to the reference voltage line Vref.

The source electrode of the fifth transistor T5 is connected to a supply voltage VDD_EL, the gate electrode of the fifth transistor T5 is connected to an emission control line of a previous stage, and the drain electrode of the fifth transistor T5 is connected to the source electrode of the driving transistor T_dr.

The source electrode of the driving transistor T_dr is connected to the drain electrode of the fifth transistor T5, the gate electrode of the driving transistor T_dr is connected to the other terminal B of the storage capacitor C, and the drain electrode of the driving transistor T_dr is connected to the first node N1. While the driving transistor T_dr is turned on, the driving transistor T_dr controls the level of current flowing through the OLED so that the OLED emits light, as mentioned earlier.

The pixel of the OLED display device according to the exemplary embodiment shown in FIG. 5 allows the fifth transistor T5 to selectively apply the supply voltage VDD_EL to the driving transistor T_dr depending on a signal EM(n−1) applied from the emission control line of a previous stage.

In other words, among the emission control signals shifted by a shift register, the emission control signal EM(n−1) at the immediately previous stage of the shift register is used as the control signal of the fifth transistor T5 in the $n^{th}$ pixel. Accordingly, during the initializing time interval I' of the pixel after the scan signal is activated until the emission control signal EM(n) is deactivated, the fifth transistor T5 is turned off by the emission control signal EM(n−1) of the immediately previous stage, such that the supply voltage VDD_EL is not applied to the driving transistor T_dr. In one embodiment, each stage of the shift register corresponds to a different emission line. Thus, the emission control signal of a previous stage may also correspond to the emission control signal provided to a previous pixel row.

That is, the supply voltage VDD_EL is prevented from being applied to the driving transistor T_DR during the initializing time interval I', such that no short-circuit is created between the supply voltage VDD_EL and the reference voltage Vref, and thus voltage at the gate terminal of the driving transistor T_dr and voltage at the anode of the OLED can be initialized to equal voltages only with the reference voltage Vref. In addition, it is possible to solve problems such as response time delay caused by the influence of previous frame data.

According to the exemplary embodiment shown in FIG. 5A, the initializing time interval I' of a pixel in which the emission control signal EM(n) as well as the scan signal Scan are in on-state, coincides with the interval in which the emission control signal EM(n−1) at the immediately previous stage is deactivated and in an off-state, as shown in FIG. 5B. It is noted that since the transistors of the display are P type transistors, the emission control signals EM and scan signal Scan are active and in the on-state when they are logic low, and they are deactivated and in the off-state when they are logic high.

Figure 3:
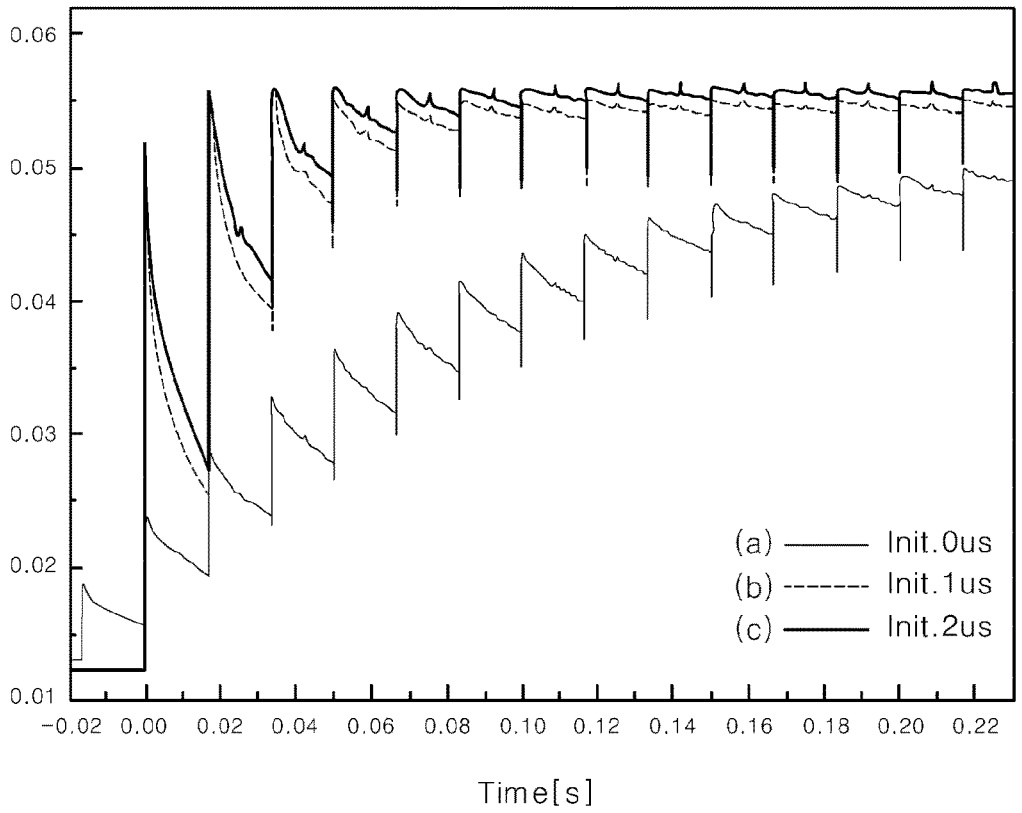
FIG. 3 is a graph showing response time characteristics of the OLED display device shown in FIG. 1 according to different initializing time intervals.

As a result, the time of 1H in which the emission control signal EM(n−1) is deactivated can be fully used as the initializing time interval of the pixel, such that performance can be further improved. 1H may refer to a single horizontal period. The relationship between the initializing time intervals and response characteristics has already been described above with reference to FIG. 3.

In the exemplary embodiment shown in FIGS. 5A and 5B, no additional element is required for generating the control signal of the fifth transistor T5. Accordingly, there is an advantage in that the OLED display device can become more compact.

Figure 6A:
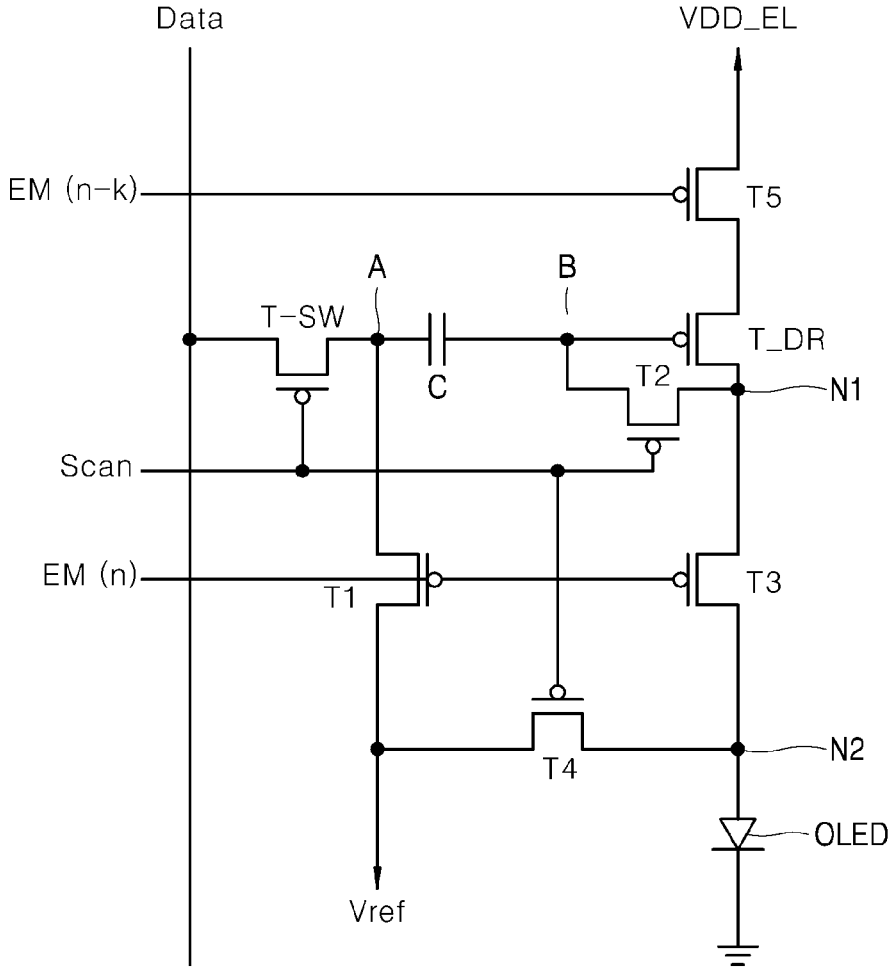
FIG. 6A is an equivalent circuit diagram of a pixel of an OLED display device according to another exemplary embodiment of the present disclosure.
Figure 6B:
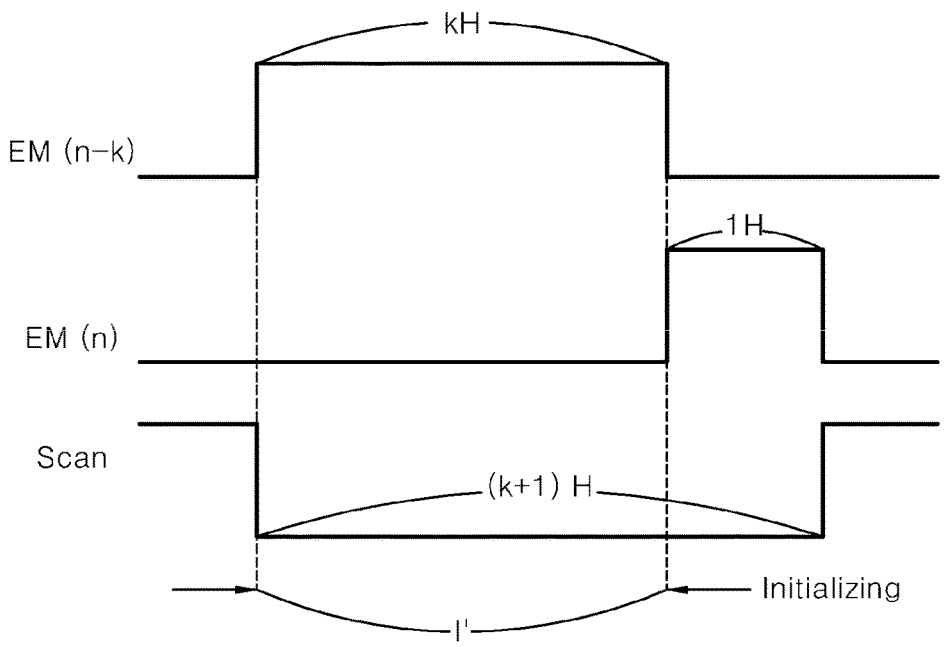
FIG. 6B is a timing chart for driving the OLED display device of FIG. 6A.

FIG. 6A is an equivalent circuit diagram of a pixel of an OLED display device according to another exemplary embodiment of the present disclosure. FIG. 6B is a timing chart for driving the OLED display device of FIG. 6A.

Referring to FIG. 6A, the source electrode of the switching transistor T_sw is connected to a data line DATA, the gate electrode of the switching transistor T_sw is connected to a scan line, and the drain electrode of the switching transistor T_sw is connected to a terminal A of the storage capacitor C.

The source electrode of the first transistor T1 is connected to a reference voltage Vref line, the gate electrode of the first transistor T1 is connected to an emission control line, and the drain electrode of the first transistor T1 is connected to the terminal A of the storage capacitor C.

The source electrode of the second transistor T2 is connected to the other terminal B of the storage capacitor C, the gate electrode of the second transistor T2 is connected to the scan line, and the drain electrode of the second transistor T2 is connected to a first node N1.

The source electrode of the third transistor T3 is connected to the first node N1, the gate electrode of the third transistor T3 is connected to the emission control line, and the drain electrode of the third transistor T3 is connected to a second node N2.

The source electrode of the fourth transistor T4 is connected to the second node N2, the gate electrode of the fourth transistor T4 is connected to the scan line, and the drain electrode of the fourth transistor T4 is connected to the reference voltage line Vref.

The source electrode of the fifth transistor T5 is connected to a supply voltage VDD_EL, the gate electrode of the fifth transistor T5 is connected to an emission control line of one of the previous stages, and the drain electrode of the fifth transistor T5 is connected to the source electrode of the driving transistor T_dr.

In the exemplary embodiment shown in FIG. 7, an emission control signal EM(n−k) at a previous stage of a shift register is applied as the control signal of the fifth transistor T5, where k is a natural number satisfying the relationship n>k>1.

Specifically, in the structure shown in FIG. 6A, the emission control signal EM(n-k) at a previous stage ahead of the $n^{th}$ stage by k stages is received and is provided as the control signal of the fifth transistor T5 after the scan signal Scan is activated until the emission control signal EM(n) is deactivated, such that the initializing time interval I' can be increased.

In other words, according to the exemplary embodiment, the initializing time interval in which the control signal of the fifth transistor T5 is supplied equals to the time of kH, and accordingly, the scan signal is supplied for the time of (k+1)H in each of the pixels, as can be seen from FIG. 6B.

It is to be understood that an additional signal control process may be further included for supplying the emission control signal EM(n−k) until the initialization of the pixel is completed. In one embodiment, an emission control signal EM(n−k) from a previous stage of a shift register may be input to a processing circuit. The processing circuit generates a processed signal from the emission control signal EM(n−k), which can then be provided to the fifth transistor T5.

Figure 7A:
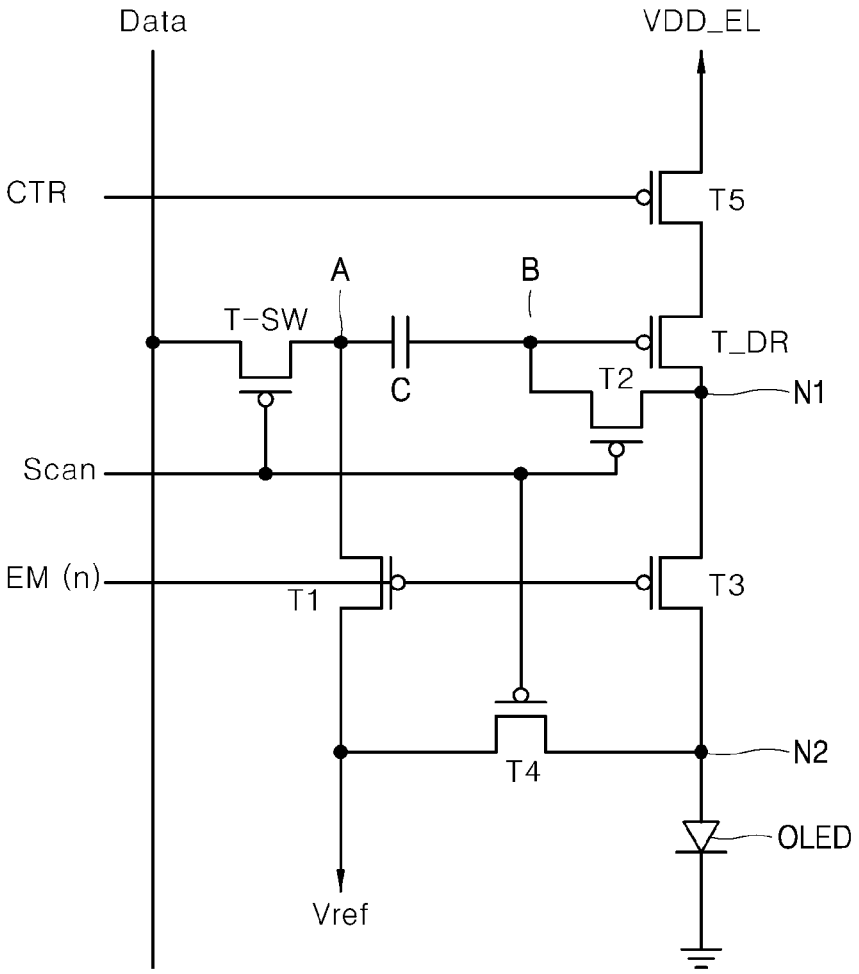
FIG. 7A is an equivalent circuit diagram of a pixel of an OLED display device according to yet another exemplary embodiment of the present disclosure.
Figure 7B:
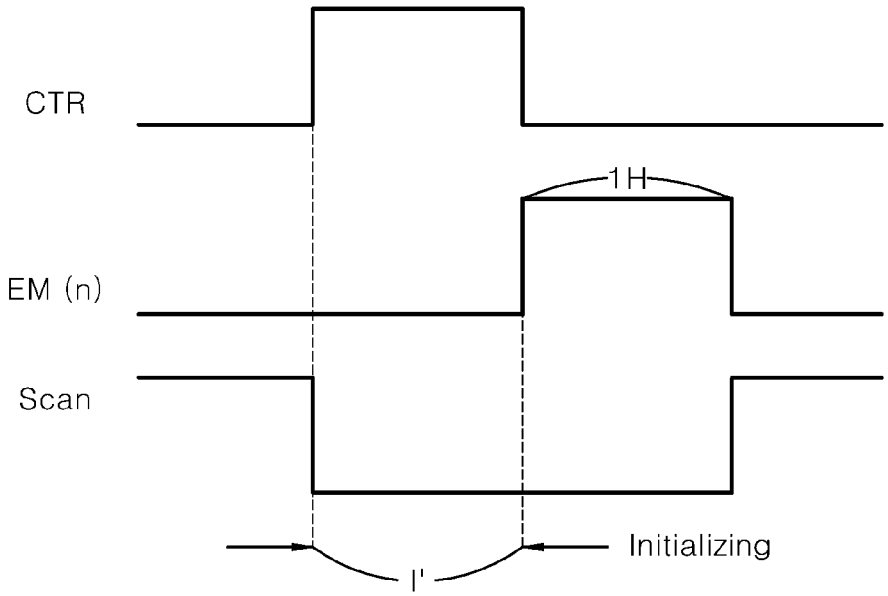
FIG. 7B is a timing chart for driving the OLED display device of FIG. 7A.

FIG. 7A is an equivalent circuit diagram of a pixel of an OLED display device according to yet another exemplary embodiment of the present disclosure. FIG. 7B is a timing chart for driving the OLED display device of FIG. 7A.

FIG. 7A shows an exemplary embodiment in which a control signal CTR applied from a separate driving circuit is used as the control signal of the fifth transistor T5. Specifically, in the exemplary embodiment shown in FIG. 7A, the fifth transistor T5 is operated by the control signal CTR applied from the separate driving circuit dedicated to generating the control signal of the fifth transistor T5, such that there is an advantage in that the control signal CTR best suitable for the condition and configuration of the OLED display device can be provided.

Accordingly, in the OLED display device according to the exemplary embodiment shown in FIG. 7A, it is possible to apply a control signal CTR that achieves the best efficiency/performance, and it is also possible to set the initializing time interval I' determined by the control signal CTR as desired.

The driving circuit for generating the control signal CTR may be disposed in the gate driver 430 (see FIG. 4), for example. It is to be understood that a control line for supplying the control signal CTR may be in parallel with the scan line GL. In one embodiment, the driving circuit generating the control signal CTR is separate in the sense that it is separate and distinct from the circuit that generates the emission signals EM. The control signal CTR is also applied via a control line that is separate and distinct from the emission lines. As a result, the control signal CTR does not serve as the emission control signal of any other pixels.

The other elements such as the transistors T1 to T5, T_sw and T_drive, the storage capacitor C and the OLED are identical to those described above.

Figure 8:
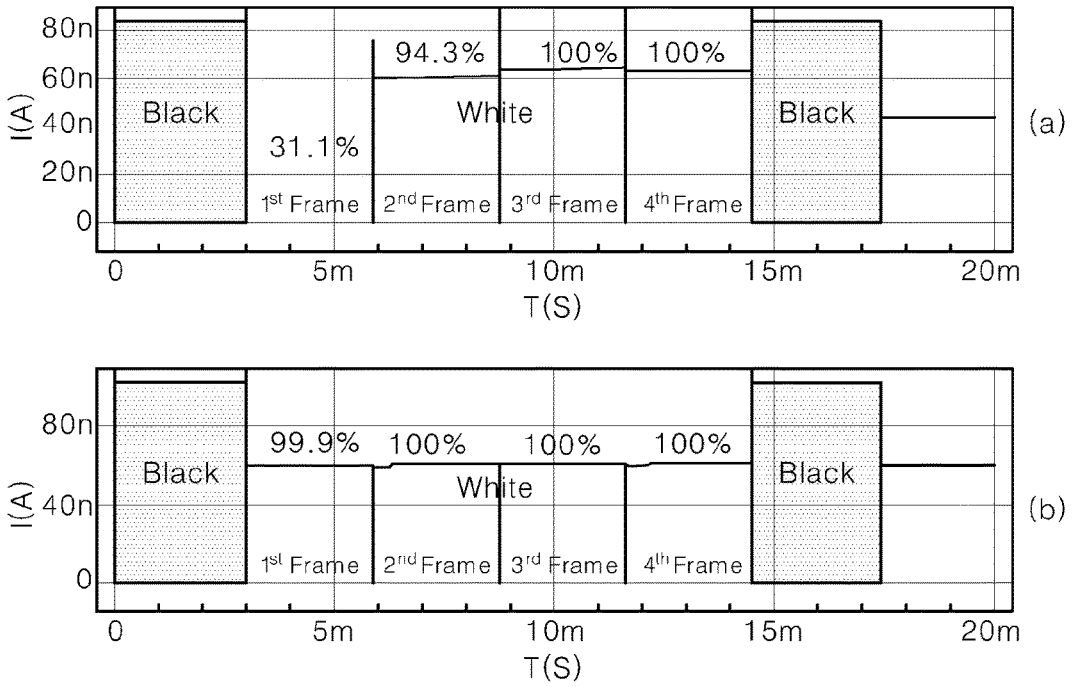
FIG. 8 includes graphs comparing response characteristics of the OLED display device in the related art with those according to an exemplary embodiment of the present disclosure.

FIG. 8 includes two graphs comparing response characteristics of the OLED display device in the related art with those according to an exemplary embodiment of the present disclosure. The top graph shows response characteristics of an OLED display device in the related art; and the bottom graph shows response characteristics of an OLED display device according to an exemplary embodiment of the present disclosure.

When the screen is changed from black to white, the 6T1C pixel exhibits luminance efficiency of 31.1% at the first frame and luminous efficiency of 94.3% at the second frame. In contrast, the 7T1C pixel according to the exemplary embodiment of the present disclosure exhibits almost complete luminous efficiency (99.9%) even from the first frame.

As set forth above, according to an exemplary embodiment of the present disclosure, during the initializing time interval of each pixel in the OLED display device, the initialization of the transistor in each pixel is carried out only with the reference voltage Vref. In addition, response characteristics can be improved and defects such as afterimage effects or spots can be suppressed.

The present disclosure described above may be variously substituted, altered, and modified by those skilled in the art to which the present invention pertains without departing from the scope and sprit of the present disclosure. Therefore, the present disclosure is not limited to the above-mentioned exemplary embodiments and the accompanying drawings.

What is claimed is:

1. An organic light-emitting diode (OLED) display panel comprising:

a scan line for transmitting a scan signal, and a data line for transmitting a data signal, the scan line intersecting the data line;

a switching transistor to allow the data signal to be supplied to an output stage in response to the scan signal;

a capacitor to store a voltage corresponding to the data signal;

a driving transistor to control a current applied to an OLED based on the voltage stored in the capacitor;

a first transistor connected to an emission control line, a reference voltage line and a terminal of the capacitor;

a second transistor connected to the scan line, another terminal of the capacitor and a first node;

a third transistor connected to the emission control line, the first node and a second node;

a fourth transistor connected to the scan line, the reference voltage line and the second node; and a fifth transistor connected to a control line, a supply voltage terminal, and the driving transistor, wherein an emission control signal is applied via the emission control line, and wherein another emission control signal or a dedicated control signal is used as a control signal of the fifth transistor to selectively block a supply voltage signal from the supply voltage terminal, wherein the another emission control signal is from a kth previous stage of a circuit that generates the emission control signal supplied via the emission control line, wherein k is a natural number greater than 1.

2. The OLED display panel of claim 1, wherein the another emission control signal is from an immediately previous stage of a circuit that generates the emission control signal.

3. The OLED display panel of claim 1, wherein the dedicated control signal is generated from a control signal generator that is separate from a circuit that generates the emission control signal.

4. The OLED display panel of claim 1, wherein the control line applies a control signal to the fifth transistor, and the control signal is continuously applied in an active state after the scan signal is activated until the emission control signal supplied via the emission control line is deactivated.

5. The OLED display panel of claim 1, wherein the control line applies a control signal to the fifth transistor, and the scan signal is continuously applied in an active state while the control signal is supplied in an active state and the emission control signal EM(n) is deactivated (1H).

6. The OLED display panel of claim 1, wherein the switching transistor, the capacitor, the driving transistor, the first transistor, the second transistor, the third transistor, the fourth transistor, and the fifth transistor are all included within a pixel of the OLED display panel.

7. An organic light-emitting diode (OLED) display device comprising:

a display panel to display images;

a gate driver to supply a scan signal via a scan line;

a data driver to supply a data signal to the display panel via a data line; and a timing controller to control driving timings of the gate driver and the data driver, wherein the display panel comprises:

a switching transistor to allow the data signal to be supplied to an output stage in response to the scan signal;

a capacitor configured to store a voltage corresponding to the data signal;

a driving transistor to control a current applied to an OLED based on the voltage stored in the capacitor;

a first transistor connected to an emission control line, a reference voltage line and a terminal of the capacitor;

a second transistor connected to the scan line, another terminal of the capacitor and a first node;

a third transistor connected to the emission control line, the first node and a second node;

a fourth transistor connected to the scan line, the reference voltage line and the second node; and a fifth transistor connected to a control line, a supply voltage terminal, and the driving transistor, wherein an emission control signal is applied via the emission control line, and wherein another emission control signal or a dedicated control signal is used as a control signal of the fifth transistor to selectively block a supply voltage signal from the supply voltage terminal, wherein the another emission control signal is from a kth previous stage of a circuit that generates the emission control signal supplied via the emission control line, wherein k is a natural number greater than 1.

8. The OLED display device of claim 7, wherein the another emission control signal is from an immediately previous stage of a circuit that generates the emission control signal.

9. The OLED display device of claim 7, further comprising:

a control signal generator that is separate from a circuit that generates the emission control signal, the control signal generator configured to generate the dedicated control signal and supply the dedicated control signal to the fifth transistor via the control line, wherein the fifth transistor uses the dedicated control signal supplied from the control signal generator via the control line to selectively block a supply voltage signal from the supply voltage terminal.

10. The OLED display device of claim 7, wherein the control line applies a control signal to the fifth transistor, and the control signal is continuously applied in an active state after the scan signal is activated until the emission control signal EM(n) supplied via the emission control line is deactivated.

11. The OLED display device of claim 7, wherein the control line applies a control signal to the fifth transistor, and the scan signal is continuously applied in an active state while the control signal is supplied in an active state and the emission control signal is deactivated.

12. The OLED display device of claim 7, wherein the switching transistor, the capacitor, the driving transistor, the first transistor, the second transistor, the third transistor, the fourth transistor, and the fifth transistor are all included within a pixel of the display panel.

13. A method for driving an organic light-emitting diode (OLED) display device comprising a switching transistor, a driving transistor, a first transistor, a second transistor, a third transistor, a fourth transistor, a fifth transistor and a capacitor, the method comprising:

supplying a scan signal as well as an emission control signal to turn on the switching transistor, the driving transistor, the first transistor, the second transistor, the third transistor and the fourth transistor;

supplying a control signal while the emission control signal is supplied to turn off the fifth transistor; and supplying a reference voltage to the turned-on switching transistor, driving transistor, first transistor, second transistor, third transistor, and fourth transistor to initialize them while the scan signal as well as the emission control signal are supplied, wherein the turned-off fifth transistor blocks a supply voltage signal from being supplied to the driving transistor while the switching transistor, driving transistor, first transistor, second transistor, third transistor, and fourth transistor are initialized, wherein a processed signal of another emission control signal is used as a control signal, and wherein the another emission control signal is from a kth previous stage of a circuit that generates the emission control signal, wherein k is a natural number greater than 1.

14. The method of claim 13, wherein the another emission control signal is used as the control signal, wherein the another emission control signal is from an immediately previous stage of a circuit that generates the emission control signal.

15. The method of claim 13, wherein a dedicated control signal is used as the control signal of the fifth transistor, wherein the dedicated control signal is generated by a control signal generator that is separate from a circuit that generates the emission control signal.

16. The method of claim 13, wherein the control signal is continuously applied in an active state after the scan signal is activated until the emission control signal is deactivated.

17. The method of claim 13, wherein the scan signal is continuously applied in an active state while the control signal is supplied in an active state and the emission control signal is deactivated.

* * * * *